United States Patent [19]

Stuckas

[11] 4,408,585

[45] Oct. 11, 1983

[54] FUEL CONTROL SYSTEM

[75] Inventor: Kenneth J. Stuckas, Mobile, Ala.

[73] Assignee: Teledyne Industries, Inc., Los Angeles, Calif.

[21] Appl. No.: 321,911

[22] Filed: Nov. 16, 1981

Related U.S. Application Data

[63] Continuation-in-part of Ser. No. 88,767, Oct. 29, 1979, Pat. No. 4,305,364.

[51] Int. Cl.[3] ..... F02M 7/00; F02B 3/00

[52] U.S. Cl. ..... 123/440; 123/486; 123/489; 60/39.281

[58] Field of Search ..... 123/440, 434, 446, 464, 123/430, 431, 445, 446, 486, 447, 456, 557, 460, 489; 60/39.28 R

[56] References Cited

U.S. PATENT DOCUMENTS

| | | | |
|---|---|---|---|
| 3,142,967 | 8/1964 | Schweitzer | 60/105 |
| 3,596,643 | 8/1971 | Schweitzer | 123/117 |
| 3,911,285 | 10/1975 | Yannone et al. | 290/40 |
| 3,945,350 | 3/1976 | Ford | 123/32 |
| 3,960,120 | 6/1976 | Aono et al. | 123/32 |
| 3,987,620 | 10/1976 | Giordano et al. | 60/39.28 |
| 4,004,412 | 1/1977 | Burnell | 60/39.28 |
| 4,015,569 | 4/1977 | Leshner et al. | 123/133 |
| 4,015,572 | 4/1977 | Leshner et al. | 123/139 |
| 4,047,507 | 9/1977 | Noguchi et al. | 123/32 |
| 4,062,337 | 12/1977 | Rivere | 123/140 |
| 4,089,317 | 5/1978 | Drews | 123/179 |
| 4,106,450 | 8/1978 | Norimatsu et al. | 123/119 |
| 4,106,451 | 8/1978 | Hattori et al. | 123/119 |
| 4,111,171 | 11/1978 | Aono et al. | 123/119 |
| 4,121,546 | 10/1978 | Hattori et al. | 123/32 |
| 4,232,643 | 11/1980 | Leshner et al. | 123/440 |
| 4,282,842 | 8/1981 | Sarayama | 123/446 |

*Primary Examiner*—Raymond A. Nelli

*Attorney, Agent, or Firm*—Gifford, VanOphem, Sheridan & Sprinkle

[57] ABSTRACT

A fuel control system for a spark ignition internal combustion engine of the type having a source of fuel and a pump for supplying the fuel from the fuel source and to the engine at variable flow rates. The fuel control system of the present invention is particularly suited for a reciprocating piston aircraft engine and is designed to minimize brake specific fuel consumption of the engine during steady state engine operation. The fuel control system utilizes a microprocessor to determine the peak value of the exhaust gas temperature and, once the peak has been found, repeatedly decreases the fuel flow rate to the engine in predetermined increments until the exhaust gas temperature is less than its peak value by a predetemined amount. At this time, the fuel control system maintains a constant fuel flow rate to the engine.

6 Claims, 3 Drawing Figures

FUEL CONTROL SYSTEM

CROSS REFERENCE TO RELATED APPLICATIONS

The instant application is a continuation-in-part of U.S. patent application Ser. No. 88,767, entitled FUEL CONTROL SYSTEM, filed on Oct. 29, 1979 and now U.S. Pat. No. 4,305,364.

FIELD OF THE INVENTION

The present invention relates to a fuel control system and, more particularly, to a fuel control system for an internal combustion engine.

DESCRIPTION OF THE PRIOR ART

In spark-ignition internal combustion engines, such as aircraft piston engines, the engine is normally supplied with a charge of fuel through either carburetion or fuel injection so that the charge of fuel, when mixed with the inducted air charge, provides a combustible mixture to the engine combustion chambers or cylinders. The quantity of the fuel supplied to the engine can be regulated by a number of different means.

In most present aircraft piston engines, however, the fuel system is manually controlled by means of a mixture control lever. This lever is operated by the pilot to provide leaner fuel mixtures to the engine for improved fuel economy and also to avoid excessively rich mixtures at higher altitudes. Such excessively rich mixtures can result in inconsistent engine combustion and even stalling of the engine.

Normally the mixture control lever of the aircraft is operated by the pilot in response to one or more predetermined engine operating parameters such as the exhaust gas temperature (EGT), the cylinder head temperature (CHT), the fuel flow rate, the altitude, the engine speed and/or the manifold pressure. Consequently, the control and adjustment of the mixture control lever by the pilot unduly increases the pilot workload and at the same time can result in an improper fuel mixture to the engine. An improper fuel mixture to the engine results not only in excessive fuel consumption but also in engine damage from excessive cylinder head temperature.

SUMMARY OF THE PRESENT INVENTION

The present invention overcomes the disadvantages of the previously known fuel mixture control systems by providing an automatic fuel mixture control system which minimizes the brake specific fuel consumption during study state operation of the engine.

In brief, the present invention comprises a microcomputer fuel mixture control system which is particularly suited for an aircraft piston engine having a source of fuel and means for supplying the fuel to the engine at variable flow rates. The fuel system initially increases the fuel flow rate to the engine thus providing an overly rich fuel mixture. The fuel flow rate is then incrementally decreased while simultaneously measuring the value of the exhaust gas temperature at each incremental decrease in the flow rate. This process is repeated until the peak exhaust gas temperature is reached.

Thereafter, the fuel control system further decreases the fuel flow rate to the engine in predetermined fuel flow increments while measuring the exhaust gas temperature at each incremental decrease in the fuel flow rate. This process is repeated until the exhaust gas temperature is less than its peak value by a predetermined amount. The fuel control system thereafter maintains a steady fuel flow rate to the engine as long as the engine remains in a steady state condition.

An important feature of the present invention is that the fuel flow rate to the engine is decreased until the temperature of the exhaust gas is less than the peak exhaust gas temperature by a predetermined amount or temperature offset, regardless of the value of the peak exhaust gas temperature. In addition, in practice it has been found that the brake specific fuel comsumption (BSFC) for any particular engine can be minimized by simply changing the temperature offset, i.e., the temperature differential between the peak exhaust gas temperature and the temperature of the exhaust gas at the minimum brake specific fuel consumption, for that particular engine.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

The fuel control system of the present invention is particularly suited for use with a spark-ignition internal combustion engine of the type used in aircrafts and thus will be described for use with such an aircraft engine. However, no undue limitations should be drawn therefrom since the fuel control system of the present invention can be adapted for use with other types of spark-ignition internal combustion engines.

Figure 1:
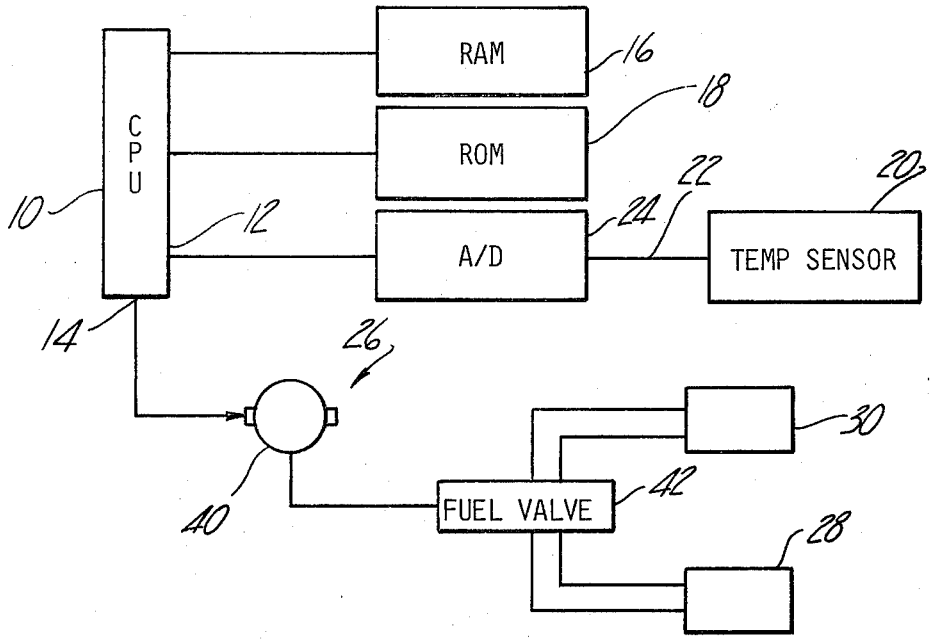
FIG. 1 is a block diagrammatic view illustrating a preferred embodiment of the fuel control system of the present invention.

With reference first to FIG. 1, a block diagram of the fuel control system is thereshown and comprises a microcomputer or microprocessor 10 having an input port 12 and an output port 14. The I/O ports 12 and 14 can alternatively comprise a single I/O port for the microprocessor 10 and, as is well known in the art, each port typically comprises a plurality of lines although only one line is illustrated in the drawing.

A random access memory 16 is operatively connected with the microprocessor 10 for the storage of temporary data values as will become hereinafter apparent. In addition, a read only memory 18 is also operatively connected with the microprocessor 10 and contains the necessary program for the microprocessor 10. Although the random access memory 16 and read only memory 18 are illustrated in FIG. 1 as external to the microprocessor 10, either or both can be contained internally within the microprocessor 10.

Still referring to FIG. 1, the fuel control system includes a temperature sensor 20 which provides an analog signal on its output 22 representative of the exhaust gas temperature (EGT) of the internal combustion engine. The output signal from the temperature sensor 20 is processed by an A/D convertor 24 which provides an output signal to the microprocessor input port 12 representative of the exhaust gas temperature. Thus, under program control, the microprocessor 10 can determine the exhaust gas temperature from the engine at any time.

Similarly, the microprocessor output port 14 provides an output signal to a variable rate fuel pumping means 26 which pumps fuel from a fuel source 28 and to the engine 30. The actual flow rate of the pump means 26 is controlled by the microprocessor 10 via its output port 14. The fuel pump means 26 is of any conventional construction, such as a stepper motor 40 which controls the position of a flow valve 42.

Figure 3:
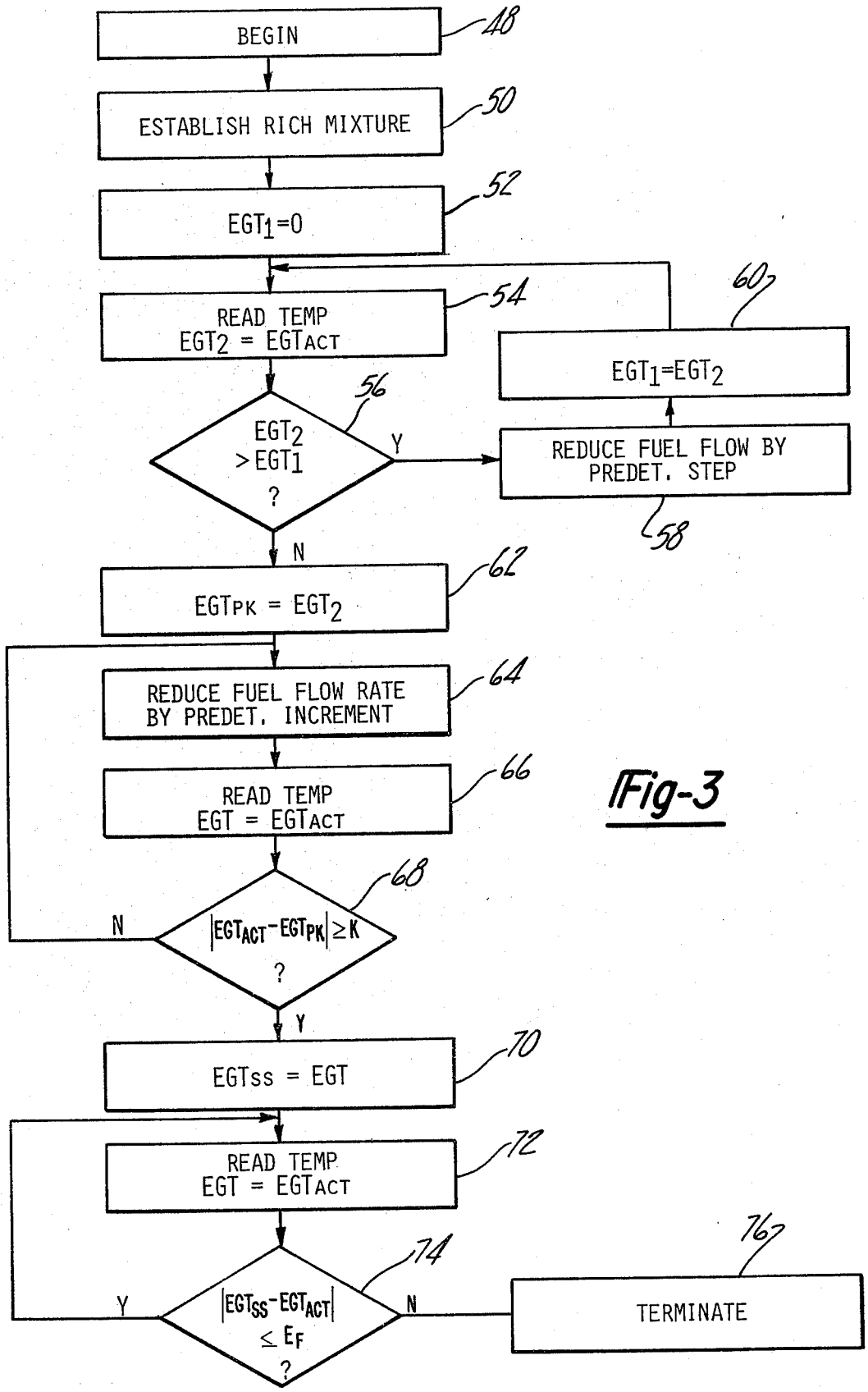
FIG. 3 is a flow chart illustrating the operation of the preferred embodiment of the fuel control system of the present invention.

With reference now to FIG. 3, a flow chart depicting the operation of the fuel control system of the present invention is thereshown. Upon initiation of the system at step 48, the fuel control system initially establishes an overly rich fuel mixture to the engine at step 50. The system attains this overly rich fuel mixture by generating the appropriate signals on its output port 14 to the fuel pump means 26 necessary to generate a high fuel flow rate to the engine 30. At step 52 an initial value of the exhaust gas temperature, $EGT_1$, is preset to a low value, such as zero.

At step 54, the actual temperature of the exhaust gases ($EGT_{act}$) as determined by the EGT sensor 20 is read by the microprocessor 10 and assigned to the value $EGT_2$. At step 56, the value of the actual exhaust gas temperature, $EGT_2$, is compared to the value of $EGT_1$. Since $EGT_1$ was initially preset to the value zero in step 52, when step 56 was first executed, $EGT_2$ will always be larger than $EGT_1$.

Since $EGT_2$ is greater than $EGT_1$ at step 56, step 56 branches to step 58 in which the microprocessor 10 reduces the fuel flow rate to the engine 30 by a predetermined increment. Such an increment in the fuel flow rate is accomplished by the microprocessor 10 by generating the appropriate signal on its output port 14 to the variable pump means 26.

At step 60, the value of $EGT_2$, i.e., the temperature of exhaust gases as determined in step 54, is assigned to the variable $EGT_1$ and control of the system is again returned to step 54 where the actual temperature of the exhaust gases is again determined and assigned to the variable $EGT_2$. The fuel control system, furthermore, includes a time delay (not shown) between steps 58 and 54 to enable the reduction of the fuel flow rate to the engine at step 58 to have a readable effect on the temperature on the engine exhaust gases before the temperature of the exhaust gases is again read at step 54.

From the foregoing, it can be seen that steps 54–60 are reiteratively repeated as long as the reduction of the fuel flow rate to the engine at step 58 produces an increase in the exhaust gas temperature. Conversely, when the reduction in the fuel flow increment results in the reduction of the exhaust gas temperature, step 56 branches to step 62 which assigns the value of the last determined exhaust gas temperature, $EGT_2$ to a variable $EGT_{PK}$, i.e., the peak value of the exhaust gas temperature.

Step 64 then reduces the fuel flow to the engine 30 by a predetermined increment. After a short delay step 66 again reads the actual exhaust gas temperature $EGT_{act}$ as determined by the output of the temperature sensor 20. At step 68, the difference between the exhaust gas temperature, $EGT_{act}$, and the peak value of the exhaust gas temperature, $EGT_{PK}$, is determined and, if this difference is less than a constant K, steps 64 and 66 are reiteratively repeated.

As can be seen from the foregoing, steps 64–68 repeatedly decrease the fuel flow rate to the engine in predetermined increments until the temperature of the exhaust gas is less than the peak temperature of the exhaust gas by a predetermined amount, i.e., the constant K. Furthermore, this temperature offset K remains the same regardless of the actual value of the peak exhaust gas temperature.

Once the difference between the exhaust gas temperature and the peak exhaust gas temperature is equal to or greater than the constant K, step 70 assigns the current value of the exhaust gas temperature as determined by the temperature sensor 20 to the parameter representative of the exhaust gas temperature at steady state, $EGT_{SS}$. Steps 72 and 74 then reiteratively read the value of the exhaust gas temperature and compare the current $EGT_{act}$ to $EGT_{SS}$. In the event the absolute difference between $EGT_{SS}$ and the currently read value of the exhaust gas temperature, $EGT_{act}$, exceeds a predetermined error factor $E_f$, the fuel control system terminates at step 76. At this time, the engine may have entered a transient condition during which the fuel control system is no longer operable. Conversely, once the engine again attains a steady state condition, the fuel control system of the present invention is reinitialized beginning at step 50 in FIG. 3.

Figure 2:
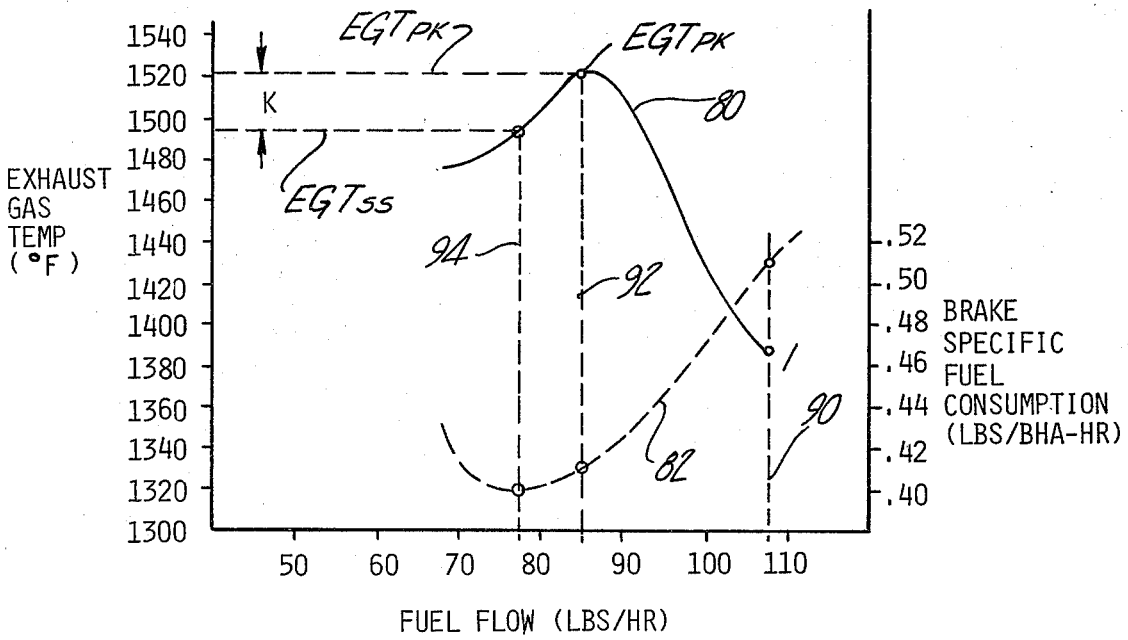
FIG. 2 is a graph illustrating the operation of the preferred embodiment of the fuel control system according to the present invention.

With reference now to FIG. 2, the operation of the fuel control system of the present invention is illustrated graphically in which the upper solid line represents the exhaust gas temperature for the engine while the lower dashed line represents the brake specific fuel consumption (BSFC) for the engine. For the best fuel economy, the BSFC is at a minimum.

With reference now to FIGS. 2 and 3, at step 50, the fuel control system initially establishes an overly rich fuel/air mixture to the engine of, for example, 108 pounds of fuel/hour as represented by reference line 90 (FIG. 2). Steps 54–60 then incrementally decrease the fuel flow rate to approximately 85 pounds of fuel/hour as represented by reference line 92 (FIG. 2). In addition, as the fuel flow rate is decreased to 85 pounds/hour the exhaust gas temperature continuously increases up to its peak value $EGT_{PK}$ and, simultaneously, the BSFC decreases from approximately 0.51 pounds/BHA-HR and to approximately 0.42 pounds/BHA-HR.

For the example shown in FIG. 2, step 62 assigns the value of 1520° F. to the parameter $EGT_{PK}$ and steps 64–68 then reiteratively decrease the fuel flow rate to the engine by the predetermined increment until the exhaust gas temperature is less than the exhaust gas temperature at the peak, $EGT_{PK}$ by the predetermined constant K. Simultaneously, the BSFC decreases to its minimum of about 0.40 pounds/BHA-HR as indicated by reference line 94 (FIG. 2). Step 70 then assigns the exhaust gas temperature to the parameter $EGT_{SS}$ and steps 72 and 74 continuously reiterate to ensure that the variation of the exhaust gas temperature from the value $EGT_{SS}$ remains within predetermined limits as established by the error factor $E_f$.

An important feature of the instant invention is that the minimum BSFC is obtained by reducing the fuel flow rate to the engine until the exhaust gas temperature is less than the peak value by a predetermined amount regardless of the actual value of the peak exhaust gas temperature. For example, as shown in FIG. 2, the peak exhaust gas temperature is equal to approximately 1520°

F. while $EGT_{SS}$ is equal to approximately 1492° F. so that K is equal to 18° F. Assuming that under different conditions the peak exhaust gas temperature attains a value of 1538° F., the fuel control system of the present invention would function to reduce the exhaust gas temperature to 1510° F. in order to obtain the minimum BSFC. Furthermore, once the exhaust gas temperature is reduced from its peak value by the predefined constant K, the fuel flow rate to the engine is maintained at a constant rate as long as the steady state condition continues.

From the foregoing, it can be seen that the fuel control system of the present invention is highly advantageous in that it utilizes a single engine parameter, the exhaust gas temperature, to minimize the brake specific fuel consumption and thus obtain the best engine fuel economy during the steady state engine operating condition. Since only a single transducer is employed by the system of the present invention, the present invention can be constructed at low cost and yet retain high reliability.

Having described by invention, however, many modifications thereto will become apparent to those skilled in the art to which it pertains without deviation from the spirit of the invention as defined by the scope of the appended claims.

I claim:

1. A fuel control system for an internal combustion engine comprising:

means for repeatedly sensing the temperature of the exhaust gases from said engine, wherein the temperature of the exhaust gases decreases from a peak value as the fuel mixture to the engine is either enriched or leaned;

means for insuring that the fuel-air ratio is initially richer than the fuel-air ratio corresponding to the peak exhaust gas temperature;

means for thereafter determining the peak exhaust gas temperature by repeatedly decreasing the fuel flow rate to the engine by predetermined fuel flow increments until the exhaust gas temperature is less than the previously determined exhaust gas temperature so that the fuel-air ratio is less than that corresponding to the peak exhaust gas temperature; and means for thereafter decreasing the fuel flow rate to the engine in predetermined increments until the exhaust gas temperature attains a steady state temperature, said steady state temperature being equal to a predetermined temperature offset from the peak exhaust gas temperature, and for thereafter maintaining a constant fuel flow rate to the engine.

2. The invention as defined in claim 1 and further comprising:

means for comparing the temperature of the exhaust gases with said steady state temperature; and means for terminating the operation of the fuel control system when said comparison exceeds a predetermined error factor.

3. The invention as defined in claim 1 wherein the means for decreasing the fuel flow rate to the engine comprises a stepper motor operatively connected to a fuel control valve means.

4. The invention as defined in claim 1 and comprising means for terminating operation of the fuel control system when the exhaust gas temperature deviates from said steady state temperature by more than a predetermined temperature value.

5. A method for fuel control for an engine having a source of fuel and means for supplying fuel from the fuel source and to the engine at variable flow rates, said method comprising the steps of:

(a) determining the value of the peak exhaust gas temperature from the engine;

(b) thereafter reducing the fuel flow rate to the engine in predetermined fuel flow increments until the exhaust gas temperature attains a steady state value, said steady state value being less than the peak exhaust gas temperature by a predetermined amount; and (c) thereafter maintaining the fuel flow rate at its current rate.

6. The invention as defined in claim 5 and further comprising the steps of terminating the fuel control method during a period of constant fuel flow whenever the exhaust gas temperature deviates from said steady state value by more than a predetermined temperature.

* * * * *